US006866767B2

(12) United States Patent
Santerre et al.

(10) Patent No.: US 6,866,767 B2
(45) Date of Patent: Mar. 15, 2005

(54) PROCESS FOR CONTROLLING ANODE EFFECTS DURING THE PRODUCTION OF ALUMINUM

(75) Inventors: Renaud Santerre, Chicoutimi (CA); Guy Pedneault, Jonquière (CA); Bernard Desgroseilliers, Chicoutimi (CA)

(73) Assignee: Alcan International Limited, Montreal (CA)

( * ) Notice: Subject to any disclaimer, the term of this patent is extended or adjusted under 35 U.S.C. 154(b) by 135 days.

(21) Appl. No.: 10/278,646

(22) Filed: Oct. 23, 2002

(65) Prior Publication Data

US 2004/0079649 A1 Apr. 29, 2004

(51) Int. Cl.[7] ..... C25C 3/06
(52) U.S. Cl. ..... 205/376; 205/392
(58) Field of Search ..... 205/376, 392

(56) References Cited

U.S. PATENT DOCUMENTS

| | | | | |
|---|---|---|---|---|
| 3,539,461 A | | 11/1970 | Newman et al. | 204/67 |
| 4,035,251 A | * | 7/1977 | Shiver et al. | 205/336 |
| 4,414,070 A | | 11/1983 | Spence | 204/225 |
| 4,425,201 A | | 1/1984 | Wilson et al. | |
| 6,402,927 B1 | | 6/2002 | Duruz et al. | 205/375 |

FOREIGN PATENT DOCUMENTS

| | | |
|---|---|---|
| DE | 29 44 518 | 4/1981 |
| EP | 0 353 943 | 2/1990 |
| EP | 0814181 | 12/1997 |
| JP | 5943891 | 3/1984 |

* cited by examiner

*Primary Examiner*—Donald R. Valentine
(74) *Attorney, Agent, or Firm*—Cooper & Dunham LLP

(57) ABSTRACT

An improved method is described for adding alumina to a Söderberg or pre-bake type electrolytic cell fed by schedule crust breaking. Instead of adding the full amount of alumina required following each crust breaking, as is traditional, the standard dose of alumina is now split into two smaller doses. Thus, a major proportion, e.g. about 50 to 90% by weight, of the theoretically required alumina to sustain the electrolysis between crust breakings is added following a crust breaking. The electrical resistance of the electrolyte is monitored between crust breakings, and if the resistance begins to rapidly increase indicating the approach of an anode effect, the anodes are activated into a pumping action thereby breaking the crust adjacent the anodes, allowing alumina to flow into the molten electrolyte, and also creating a stirring action within the molten electrolyte. This lowers the resistance such that any anode effect is avoided until the next full crust breaking.

10 Claims, 2 Drawing Sheets

PRIOR ART

PROCESS FOR CONTROLLING ANODE EFFECTS DURING THE PRODUCTION OF ALUMINUM

BACKGROUND OF THE INVENTION

This invention relates to a process for controlling the so-called "anode effect" which occurs when aluminum is produced from alumina by electrolysis.

The electrolytic reduction of alumina is normally carried out in a Hall-Heroult cell which comprises an elongated shallow container lined with a conductive material, typically carbon, used to form a cathode. The container holds a molten electrolyte, typically cryolite, containing about 2–6% by weight of dissolved alumina. A number of carbon anodes dip into the electrolyte from above. When direct current is passed through the cell, molten aluminum is formed and rests at the bottom of the cell where it forms a pool acting as the cell cathode. Carbon dioxide and monoxide gas is also liberated at the carbon anodes.

In the conventional electrolytic process, use has been made of two types of electrolytic cells, namely that commonly referred to as a "pre-bake cell" and that commonly referred to as a Söderberg cell. With either cell, the reduction process involves the same chemical reactions. The principle difference is in the structure of the cells. In the pre-bake cell, carbon anodes are baked before being installed in the cell while in the Söderberg, or self-baking anode cell, the anode is baked in situ. The present invention applies to either cell.

During the operation of such electrolytic cells, the electrolyte is held at a temperature of typically in the range of about 900 to 1000° C. to keep electrolyte and aluminum in a molten state. The temperature is lower at the electrolyte surface and here the electrolyte solidifies to form a solid crust. As the electrolysis proceeds, the concentration of the alumina in the electrolyte falls and more is added by periodically breaking the crust in limited places allowing (in side-broken cells) alumina resting on the crust to flow in.

The concentration of alumina in liquid electrolyte declines with time When the concentration falls to about 2% by weight or less, the so-called "anode effect" is observed. It manifests itself as a high voltage, e.g. in the order of 25 to 100 volts, and the appearance of perfluorocarbons in the anode gas. The anode effect has several harmful consequences. For instance, the high voltage may significantly disturb the heat balance of the cell, increase fluoride and greenhouse gas emissions and reduce current and energy efficiency.

European Patent Application 0353943 published Feb. 7, 1990 describes a method of quenching or terminating anode effects by dividing the anodes into groups and moving these up and down to "pump" the cell. This pumping action creates a degree of turbulence within the cell which distributes the alumina throughout the bath and removes the gas layer under the anode. The result is a termination of the anode effect.

A suitable system for moving the anodes up and down to pump the cell is described in Spence, U.S. Pat. No. 4,414,070 issued Nov. 8, 1983. This design provides for several modes of pumping operations based on up and down movement of various combinations of anodes.

Another process for influencing the anode effect is described in published German Application DE 2,944,518 A1 published Apr. 2, 1981. In this process, vertical movement of the anodes takes place after the voltage within the cell reaches a certain critical level. The movement of the anodes and the addition of alumina is used to restore the cell to normal operation.

In Newman et al. U.S. Pat. No. 3,539,461, patented Nov. 10, 1970, anode effect in an electrolytic cell is terminated by determining when the voltage drop across a cell exceeds about 150% of normal operating value and lowering the cell anodes so as to reduce the anode-cathode distance in the cell from about 30 to about 60% of the normal operating distance. In this procedure the available alumina concentration in the bath or electrolyte is adjusted from about 2 to about 6% by weight and the anode is raised to restore the normal anode-cathode distance and the anode effect is terminated.

In a typical operation using a cell of the Söderberg or pre-bake type, alumina is added to the cell at the sides between the anodes and the cathode side walls. A slug of alumina is deposited on the crust in these areas either by way of an integral manually or automatically activated hopper system or by way of a mobile vehicle that moves from cell to cell. Crust breaking is accomplished by either an automated integral bar, or manually using a mobile vehicle with a chisel-like projection or wheel device on the end of a moveable arm.

Another way of feeding the alumina is by a fully automatic point breaker system now in use in most large pre-bake cells. In this system, the alumina is added to the center of the cell between the anodes by means of a combined feeding/crust breaking device which is under computer control and is tied directly to cell resistance monitoring devices and software.

In the manual alumina feeding systems, the same resistance monitoring technique is used, but in this case, it is a stand-alone system. The disadvantage of the manual method of feeding is that it traditionally results in more anode effects because the feeding is not carefully controlled. Because of this lack of control, the anode effect is used periodically to clean up the alumina sludge which tends to build up in the bottom of the cell.

It is an object of the present invention to provide a feeding strategy for a manual system that reduces the anode effect occurrence rate to approximately that of the automated system.

SUMMARY OF THE INVENTION

The present invention involves a system which makes it possible to add just the right amount of alumina each time in a manual system so that excess alumina does not accumulate in the form of sludge on the bottom of the cell, and thus obviating the need for anode effects to clean up this sludge.

Unlike the point-breaker cells in which many small doses of alumina are added over time by an automated crust breaking device, the manually fed cells are constrained to one break cycle, typically every 4 to 12 hours. Since these cycles are so far part, each slug of alumina must be large enough to ensure that the cell does not run out before the next scheduled crust breaking. This means that at least for part of the time there is an oversupply of alumina in the cell and resulting sludge formation.

According to the present invention, instead of adding the full amount of alumina required following each crust breaking, as is traditional, the standard dose of alumina is now split into two smaller doses. Thus, a major proportion, e.g. about 50 to 90% by weight, of the theoretically required alumina to sustain the electrolysis between crust breakings is added following a crust breaking. This serves to form the thermal-insulating crust and give protection from anode oxidation. Between the crust breakings, the electrical resistance trend within the cell is continuously monitored by well-known suitable techniques. These include various trend indicators, such as the electrical resistance increase during a selected period of time and/or the rate of change or slope of the electrical resistance. These trend indicators are re-set following a crust breaking, preferably about 1 to 2 hours after a crust breaking to give the bath time to stabilize.

The time between scheduled crust breakings is typically about 4 to 12 hours, preferably about 4 to 8 hours, and these scheduled crust breakings are referred to hereinafter as "full crust breakings". The major proportion of the theoretical total alumina addition, i.e. 50 to 90%, preferably 60 to 85%, is added shortly after, e.g. within about 90 minutes, preferably about 15 to 45 minutes, after a full crust breaking. Following this addition of alumina, the procedure varies as follows depending upon conditions.

(a) No Crust Breaking

If the electrical resistance increase indicator remains below a predetermined very low value for a few consecutive full crust breakings, then the crust breaking is cancelled.

(b) Underfeeding

If the electrical resistance increase indicator remains at a predetermined low level (but above the no crust breaking level) for a full period between full crust breakings, no secondary alumina addition is performed. However, the full crust breaking is carried out at the scheduled crust breaking.

(c) Normal Feed

Under these conditions, the electrical resistance increase indicator remains within a predetermined normal range. This indicates that the balance of the alumina addition to 100% of theoretical is required. Accordingly, a secondary alumina addition in suitable amount is performed before full crust breaking.

(d) Over Feeding

In this situation, the electrical resistance increase indicator indicates that more than the normal or theoretical amount of alumina is required. Accordingly, a further addition of alumina is made before full crust breaking to a total alumina addition of up to 150% of the theoretically required amount.

When a second addition of alumina is made during a full crust breaking cycle, this is typically done within about 30 minutes before the next full or scheduled crust breaking. Adding the alumina a few minutes before the crust breaking allows sufficient time for preheating alumina before crust breaking and facilitates the entering of alumina into the bath.

If the slope of the resistance starts to increase rapidly, indicating the approach of an anode effect, an anode pumping action is activated, causing partial crust breaking adjacent the anodes and allowing some of the alumina to flow into the molten electrolyte and to create a stirring action within the electrolyte. The combination of the alumina entering in the bath and the stirring action serves to prevent the occurrence of the anode effect so that the electrolysis is able to continue until the next full crust breaking without anode effect. The anode pumping can be activated at any necessary point between full crust breakings.

For achieving the desired pumping action according to this invention the anodes are moved up and down a relatively short distance. This is typically within a distance of about 3 to 40 mm, with a distance of 3 to 20 mm being preferred. The speed of movement up and down is typically about 0.4 to 3.0 mm/sec, and preferably about 1.0 to 2.0 mm/sec. A number of pumping cycles may be required and the cycles are typically from about 1 to 6 with 2 to 4 cycles being preferred. There is a pause after each anode movement, with each pause typically being about 5 to 40 seconds, preferably 5 to 20 seconds. The resistance is measured at the end of a pause period for each anode movement, this pause period being the time required to stabilize the cell resistance after an anode movement. If the desired resistance has been reached, inverse movement is applied. On the other hand, if the desired resistance has not been reached then another movement is done. A pumping cycle has low and high resistance targets.

The anodes may be moved up and down as a single unit, or they may be moved individually or they may be moved in various combinations in unison. One suitable system for moving the anodes is described in U.S. Pat. No. 4,414,070, incorporated herein by reference.

BRIEF DESCRIPTION OF THE DRAWINGS

In the drawings which illustrate this invention.

DESCRIPTION OF THE PREFERRED EMBODIMENTS

Figure 1:
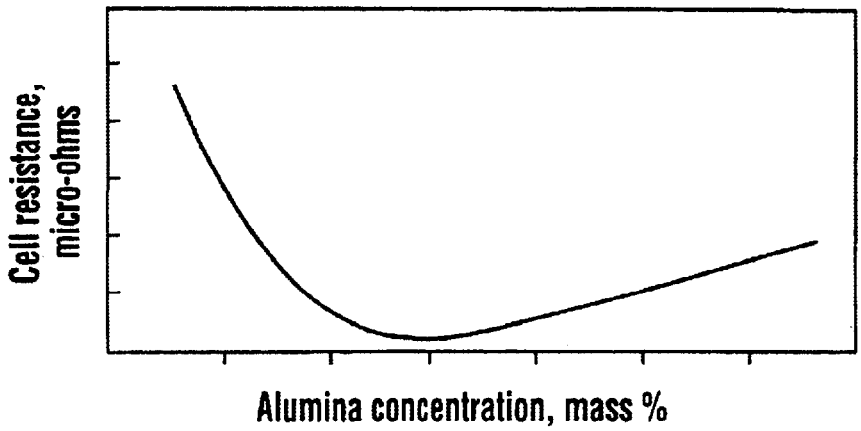
FIG. 1 PRIOR ART
FIG. 1 is a graph showing a typical variation of cell resistance with alumina concentration.
Figure 2:
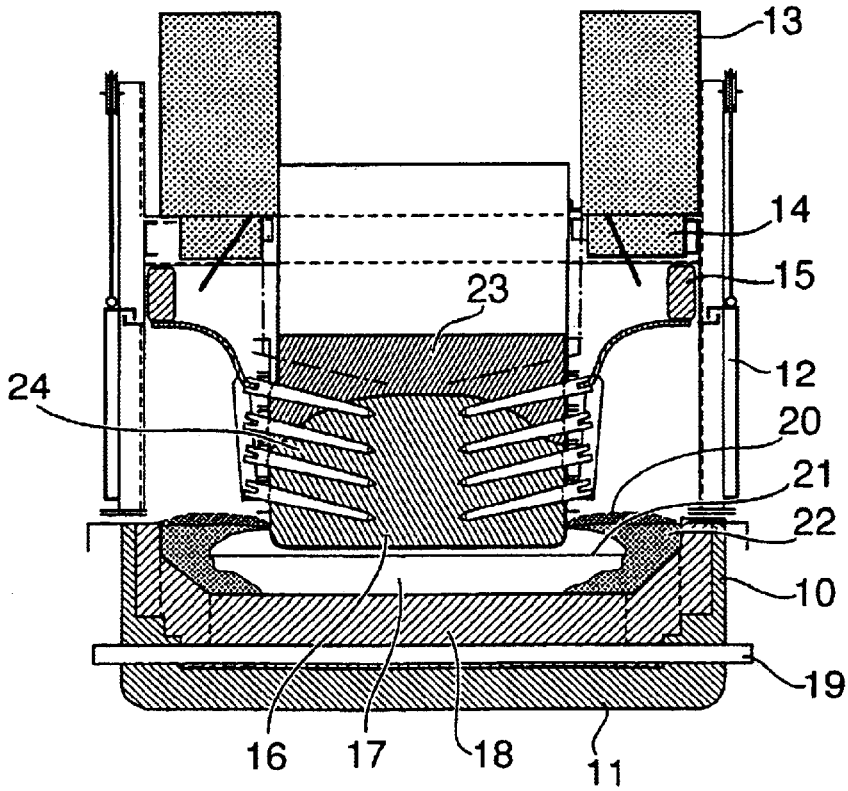
FIG. 2 is cross-section of a typical Söderberg cell.
Figure 3:
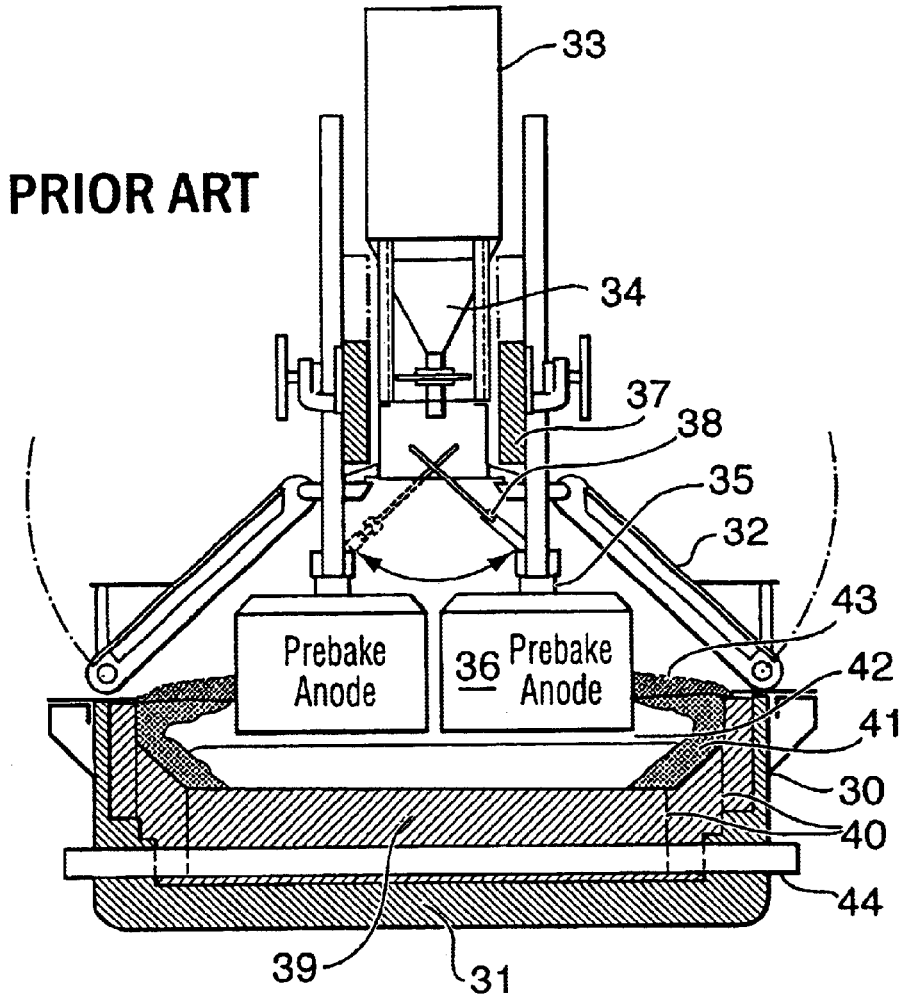
FIG. 3 is a cross-section of a typical pre-baked anode cell.

FIG. 1 shows a typical relationship between electrical conductivity and alumina concentration in a cell, while FIGS. 2 and 3 show typical cells.

The Söderberg cell in FIG. 2 has an outer shell 10 and a bottom insulation layer 11. Access to the interior of the cell is by way of doors 12. Alumina is fed from ore boxes 13 through ore valves 14 (which can be controlled by a computer) and into the region on each side of anode 16. Studs in the anode are connected to bus bar 15. Electrolyte 21 surrounds the bottom of anode 16 and metal 17 forms on cathode 18 connected to collector bar 19. A crust 22 forms at the sides of the cell and alumina 20 rests on the crust until the crust is broken. The anode is shown partially baked with an upper anode paste 23 and baked carbon 24.

In the pre-baked anode cell of FIG. 3, there is an outer shell 30 and a bottom insulation 31. Access to the interior of the cell is provided by doors 32. Alumina is fed from ore box 33 via ore valve 34 (which can be computer controlled). Pre-baked anodes 36 are held by studs 35 and connected to bus bar 37. Deflector 38 serves to direct the flow of alumina. A cathode 39 and collector bar 44 are located beneath the anodes 36 with the bottom of the anodes resting within the electrolyte 42. A crust 41 forms at the upper surfaces of the electrolyte and alumina 43 is deposited on top of the crust for subsequent addition to the electrolyte.

It will be seen from FIG. 1 that there is an alumina concentration at which there is a minimum cell resistance. As the alumina concentrations continue to rise, there is a gradual increase in cell resistance. During electrolysis, the alumina concentration in the bath reduces slowly and moves from the right to the left side of minimum cell resistance on the curve. As the alumina concentration decreases below the minimum, there is initially a relatively slow increase in resistance, but then the curve quickly becomes quite steep. This rapid rise in resistance (steep slope) indicates an impending anode effect.

The feeding sequence according to the present invention takes into consideration the patterns observed in FIG. 1. The objective is to have the alumina concentration in the bath just before crust breaking within a concentration band on the low alumina concentration side to the left of the minimum cell resistance on the curve. Sludge may be considered as undissolved alumina located in the cell bottom. The alumina concentration in the bath reduces slowly and moves from the right to the left side of the minimum cell resistance on the curve. Thus, the objective of the process of the invention is to maintain the alumina concentration within controlled limits on the left side of the minimum cell resistance on the curve. This is achieved according to the invention by adjusting the alumina addition using electrical resistance monitoring as described above.

It is important to conduct anode pumping at the right time to avoid anode effects. If the pumping is too soon, there is a high probability that it was not actually required, and if the pumping is too late, there is a high probability of having an anode effect.

Figure 4:
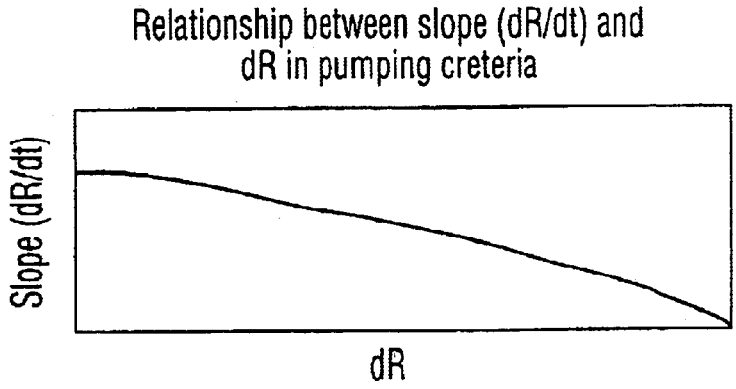
FIG. 4 is a graph showing the relationship between dR/dt and dR in anode pumping criteria.

FIG. 4 shows the relationship between the slope (dR/dt) and resistance increase (dR) in anode pumping criteria. Various levels of (dR and slope) criteria have been fixed for pumping to cover the maximum possibilities.

EXAMPLE 1 (Pre-baked)

A series of tests were run using commercial 70,000 ampere pre-bake anode cells operating at about 4.8 to 5.1 volts. The electrolyte was primarily cryolite containing about 2% to 6% by weight of dissolved alumina. The cell resistance was continuously measured and fed to a data processor.

The cells were operated with a time period of 6 hours between full crust breaking cycles based on approximately 240 kg of alumina being consumed between full crust breaking cycles. The full crust breakings were carried out using a mobile pneumatic pick which broke the crust at the long sides of the cell. Following the crust breaking, about 180 kg of alumina was added to the fresh crust and the resistance was monitored, commencing about 90 minutes after the crust breaking. About 30 minutes before the full crust breaking, the computer completes the alumina feeding on the crust according to the values of the resistance trend indicators (0 kg underfeeding, 60 kg normal, and 120 kg overfeeding).

Between full crust breakings, a rapid increase of the cell resistance indicates the approach of an anode effect. This signaled the commencement of an anode pumping action. During the anode pumping action, the anodes traveled up through a vertical distance of about 8 to 15 mm. There was a pause of about 5 sec. after each anode movement at the top and bottom of each cycle and a total of three pumping cycles were used. This anode pumping caused some breaking away of crust adjacent the anodes and flow of alumina into the electrolyte from the top of the crust. This addition of alumina increases the alumina concentration in bath until the next full crust breaking.

What is claimed is:

1. A method of preventing an anode effect from occurring during the production of aluminum in an electrolytic cell containing a molten electrolyte including alumina and having one or more carbon-containing anodes, wherein a crust forms over the electrolyte which crust is broken along the sides of the cells in full crust breakings at intervals of about 4 to 12 hours and between the said full crust breakings an amount of alumina is added sufficient to sustain the electrolysis for the period of time between the full crust breakings, characterized in that about 50 to 90% of the theoretical amount of alumina between the full crust breakings is added to the cell within a short time following a full crust breaking, the electrical resistance within the electrolyte is continuously monitored between crust breakings, and when the detected resistance begins to rapidly increase indicating the approach of an anode effect, the anodes are activated into a pumping action thereby breaking the crust adjacent the anodes, allowing alumina to flow into the molten electrolyte and also creating a stirring action within the molten electrolyte, whereby the resistance is lowered and any anode effect is avoided until the next full crust breaking.

2. The method of claim 1 wherein the balance of the alumina to 100% of the theoretical amount is added to the cell within about 45 minutes before the next full crust breaking.

3. The method of claim 1 wherein about 50 to 90% of the theoretical amount of alumina consumed by the electrolysis is added to the cell within about 90 minutes following a full crust breaking.

4. The method of claim 1 wherein during anode pumping the anodes move through a vertical distance of about 3 to 40 mm.

5. The method of claim 4 wherein about 1 to 6 pumping cycles are used.

6. The method of claim 1 wherein 50 to 90% of alumina is added to the cell within about 90 minutes after a full crust breaking.

7. The method of claim 6 wherein the balance of the alumina is added to the cell about 45 minutes before the next full crust breaking.

8. The method of claim 1 wherein the electrical resistance increase between full crust breakings is sufficiently low such that no additional alumina is required between two full crust breakings.

9. The method of claim 1 wherein the electrical resistance increase between full crust breakings is sufficiently high such that additional alumina is added to the cell to a level above the theoretical amount consumed by the electrolysis.

10. The method of claim 1 wherein the monitoring of electrical resistance is commenced about 1 to 2 hours after a crust breaking.

* * * * *